US007409958B1

(12) United States Patent
Vacker

(10) Patent No.: US 7,409,958 B1
(45) Date of Patent: Aug. 12, 2008

(54) HAIR TRIM GUIDE

(76) Inventor: Trese J Vacker, P.O. Box 4780, Pahrump, NV (US) 89041

( * ) Notice: Subject to any disclaimer, the term of this patent is extended or adjusted under 35 U.S.C. 154(b) by 1117 days.

(21) Appl. No.: 10/064,104

(22) Filed: Jun. 11, 2002

Related U.S. Application Data

(60) Provisional application No. 60/297,873, filed on Jun. 12, 2001.

(51) Int. Cl.
*A45D 24/36* (2006.01)

(52) U.S. Cl. ..... 132/214

(58) Field of Classification Search ..... 132/213, 132/214, 319; D10/64; 2/13, 174; 351/52, 351/158, 148; 24/578.13
See application file for complete search history.

(56) References Cited

U.S. PATENT DOCUMENTS 1,385,722 A * 7/1921 Sessoms ..... 132/214
1,442,359 A 1/1923 Posnick
1,639,804 A * 8/1927 Lewis ..... 132/144
2,654,374 A * 10/1953 Richmond ..... 132/213
2,749,922 A 6/1956 Daniel et al. ..... 132/45
3,491,450 A 1/1970 Ayoub ..... 33/174
3,502,396 A * 3/1970 Greenberg ..... 351/157
3,613,694 A * 10/1971 Benjamin ..... 132/145
3,709,234 A 1/1973 Seerahn ..... 132/45
4,010,764 A 3/1977 Wagner ..... 132/45
4,106,515 A 8/1978 Miller ..... 132/45
4,137,925 A * 2/1979 Castillo ..... 132/214
6,125,857 A 10/2000 Silber ..... 132/215
6,553,680 B2 * 4/2003 Vazdi ..... 33/512

* cited by examiner

*Primary Examiner*—Robyn Doan
*Assistant Examiner*—Rachel A Running
(74) *Attorney, Agent, or Firm*—Kenehan & Lambersen, Ltd.; John C. Lambertsen

(57) ABSTRACT

A hair trim guide consisting of trim guides attached to a substantial portion of eyeglass frames, consisting of a face frame and a pair of temple pieces is provided. Projecting pegs and apertures enable the trim guides to be removably attached to the frame. Where it is desired to trim sideburns, the trim guides are attached to the temple pieces. When the trim guide is attached to the face frame, bangs may be accurately trimmed.

4 Claims, 2 Drawing Sheets

HAIR TRIM GUIDE

CROSS REFERENCE TO RELATED APPLICATIONS

This application claims the benefit of U.S. Provisional Application Ser. No. 60/297,873, filed Jun. 12, 2001.

BACKGROUND OF INVENTION

1. Field of the Invention

The present invention relates to personal grooming aids and, more particularly, to such devices as are useful for providing guidance in the trimming of body hair. More specifically, the present invention relates to a guide worn on the head to enable the even trimming of sideburns, bangs, and selected other areas of the head.

2. Description of the Prior Art

Until the development of low cost safety razors, and later, electric razors, most men elected to wear facial hair during their adult lives. Unless possessing sufficient wealth, visits to professional barbers were limited to only very special occasions. This all changed around 1900 when King Gillette invented the safety razor, and made daily shaving available to the masses.

Most men have now moved to a clean-shaven look, with sideburns of length dictated by the current fashion. Of course, adopting a clean-shaven look makes irregularities all the more noticeable. It can be difficult for a person to maintain a sharp appearance relative to all areas of the hair and face. Sideburns are an especially difficult area, since they must be trimmed individually.

In much the same manner as do-it-yourselfers get in trouble when shortening table legs by measuring from the bottom, the alternating nature of sideburn trimming can result in sideburn lengths that gradually shorten to a point well beyond that desired. Alternatively, the self-groomer takes his best shot, and the result is frequently uneven sideburns.

In response to this need, a number of different solutions have been proposed. From the cosmetic area, stencils, patches, and embossed printing devices have been suggested for assistance in the shaping of facial hair. Over time, most of these have been found to be awkward to use, difficult to align, and sometimes uncomfortable to remove.

Variations in stencil devices have offered handles, guides or the like for engaging some other part of the head, such as an ear, the bridge of the nose, a frontal bone, and so forth. This too posed a problem, since coordination ability varies so much between individuals. While one person may have no problems aligning the device, another may find it impossible to manipulate and achieve the desired results.

Some other suggested solutions have gone to the other extreme, involving multiple piece constructions that overlie the skull in a manner that conjures images of brain surgery. One sideburn trimming guide, U.S. Pat. No. 4,010,764 to Wagner, provides a metal band that fits over the head, generally from temple to temple, with another guide fitting over each ear. A similar head-fitting appliance is described in U.S. Pat. No. 4,106,515 to Miller, who uses both over the top and around the head bands to position a sideburn trimming guide.

Not only would both of these head-fitting apparatus be difficult to assemble and position on the head, over long term use their physical integrity is sure to be compromised (bent, broken, and pieces lost). A need exists for providing an accurate measure of sideburn length using an inexpensive device whose manner of use requires no special skills or coordination, and preferably resembles devices that are well known and in widespread use.

SUMMARY OF INVENTION

It is an object of the present invention to provide a sideburn and hair trimming guide that is easily positioned on the head, and is of a configuration that substantially resembles a familiar personal appliance that is worn on the head in a similar manner.

A further object is to provide a hair trimming guide that is readily adjustable to obtain different sideburn and hair lengths.

It is a further object of the invention to provide a trimming guide that encourages the even trimming of both sideburns and of other sections of hair.

These objects, as well as other objects and advantages of the present invention will become readily apparent upon review of the description of a non-limiting illustrative embodiment and the accompanying drawings.

In this regard, an eyeglass frame, less the lens rims, is provided as the supporting structure for carrying the various trim guides. The location of attachment on this supporting frame of the various guides is dependent only upon the location of the hair that is desired to be trimmed. For sideburns, the guides are attached to the temple pieces, one on each side. Where it is desired to time a person"s front bangs, the guide is attached to the front of the frame.

A plurality of holes and pegs are provided to enable a range of adjustments to obtain the desired hair and sideburn lengths. The trim guides may also be shaped to certain desired lengths, assisting the person in maintaining a consistent look. The adjustability of the guides and their position provides a user with great flexibility in obtaining a desired hair length and shape. The snap-on manner of attaching the guides provides for positive placement of the guide—yet with the ability to easily change position of the guide as may be later required.

DETAILED DESCRIPTION

Figure 1:
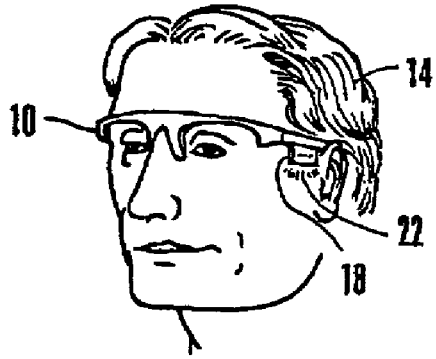
FIG. 1 is a partial perspective view of the head of a man showing a trim guide positioned thereon in accordance with the present invention.

Reference is now made to the drawings, wherein like numerals refer to like parts throughout. A trim guide 10 is shown in FIG. 1 as placed on the head of a user 14. The repeatable, accurate placement of the trim guide 10 on the user 14 is obtained by utilizing the bridge of the nose and both ears to provide three stable areas of support. In this regard, the trim guide 10 is essentially the same as a conventional eyeglass frame with the lens rims eliminated as surplusage.

As so located, a trim gauge 18 that is attached to the trim guide 10 overlies a sideburn 22 of the user 14. The extent to which the trim gauge 18 extends down from the trim guide 10 is adjustable, as will be discussed in further detail below. Once the trim gauge 18 is so fixed, placement of the trim guide 10 on the head enables the user 14 to maintain the sideburn 22 at a specified length.

While not shown in FIG. 1, the trim gauge 18 is located on both sides of the trim guide 10, permitting the user 14 to accurately set the length of each of the sideburns 22. Since the stable positioning of the trim guide 10 is established based upon the its manner of reception on the nose bridge and both ears, the extent of the trim gauge 18, and the consequent length of the sideburns 22, are similarly and repetitively fixed relative to those physical features as well. This correlates well with the manner in which professional barbers and hairdressers evaluate and establish the length of the sideburns 22.

Figure 2:
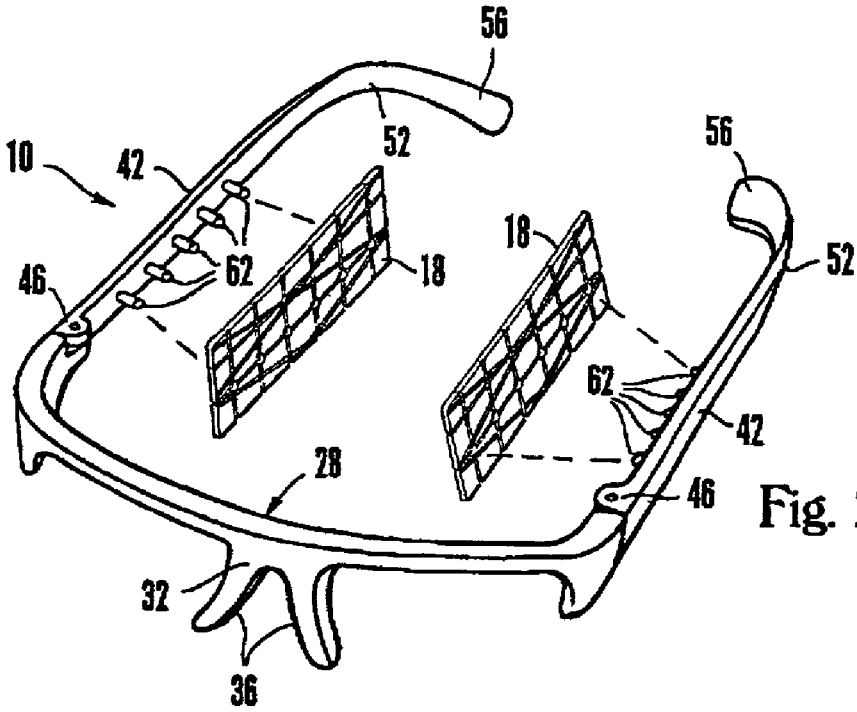
FIG. 2 is an exploded perspective view showing a trim guide in accordance with the present invention.

Turning now to FIG. 2, the trim guide 10 is reminiscent of eyeglass parts, having a front face frame 28 and a centrally located bridge 32 having a pair of opposed nose pads 36. A pair of temples 42 are attached to a pair of hinged endpieces 46, each located at an opposite end of the front face frame 28. Extending back from the front face frame 28, each of the temples 42 forms a bend 52, which in turn terminates in an earpiece 56.

The bend 52 and the earpiece 56 are configured for reception about the upper and rear exterior surfaces lying at the base of a user"s ear. Likewise, the opposed pair of nose pads 36 are shaped to conform to the outer, upper surfaces of a human nose. In this manner, the trim guide 10 is enabled to be received upon the nose and ears of the user 14 (not shown in FIG. 2) in much the same stable manner as a pair of eyeglasses.

Along an inner surface of each of the temples 42 are formed a plurality of projecting support pegs 62. Preferably equally spaced along the temple 42, the plurality of support pegs 62 provide a place of attachment for the trim gauge 18. As is best viewed in FIG. 3, each of the trim gauges 18 have a plurality of support apertures 66 formed therein and arranged to form a well-ordered array.

Figure 3:
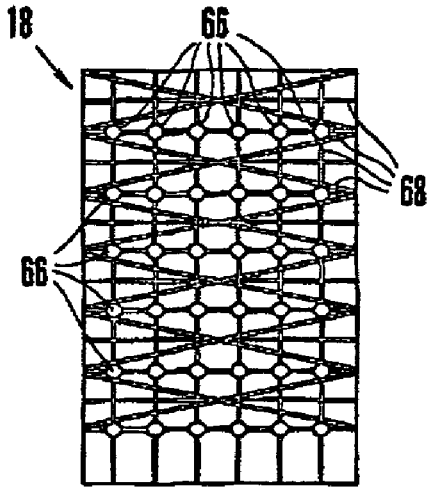
FIG. 3 is partial plan view showing an adjustable trim tab in accordance with the present invention.

As is also shown in FIG. 3, the trim gauge 18 also includes a plurality of evenly spaced horizontal and diagonal cut lines 68. Such lines formed in the material used to fabricate the trim gauge 18 permit the user to easily select and obtain the appropriate length and angle for the trim gauge 18.

Returning to FIG. 2, the support pegs 62 are shown receiving the pair of trim gauges 18 through the support apertures 66. Since the location of sideburns may vary in front-back distance from individual to individual, the lateral location of the trim gauges 18 may also be varied by changing the match up of the support pegs 62 and the support apertures 66. For example, if the sideburns of an individual are located in a more forward position, closer to the front of that person"s face, the trim gauge 18 can be shifted forward by placing the second-in-line support aperture into the first-in-line support peg (not illustrated in the drawings).

In a preferred embodiment, the trim guide 10 is fabricated out of a plastic, such as polycarbonate in an injection mold process. It is intended that the trim guide 10 be provided in a universal size, with the front face frame 28 extending a distance of approximately six (6) inches between the two hinged endpieces 46. The bridge 32 extends down from the face frame 28 a distance of approximately one (1) inch, with the nose pads curving from their junction at the face frame 28 to a separated distance of ⅞ of an inch at their ends.

The temples 42 each have length of approximately 4¾ inches, with the bend 52 beginning approximately 3½ inches from the hinged endpiece 46, and the width of the temples 42 expanding from ¼" ⅜" at the bend 52 to approximately ½" at the earpiece 56.

In a preferred embodiment there are five (5) of the support pegs 62 attached to each of the temples 42, with adjacent support pegs separated a distance of approximately ⅜" inches. The support pegs 62 project from the temple 42 a distance of 3⁄16 inches. The support apertures 66 are of ⅛" diameter, with center-to-center spacing of approximately ⅜", to permit the easy reception of the trim gauge on the appropriate support pegs 62.

The trim gauge 18 is preferably fabricated out of a plastic, such as Nylon of thickness 1⁄16". To permit the easy adjustment in the length of the trim gauge 18, the cut lines 68 extend into each side of the trim gauge 18 one-quarter of its thickness. In this manner, length or angle adjustment merely requires the cutting of the trim gauge along one of the cut lines 68.

Figure 4:
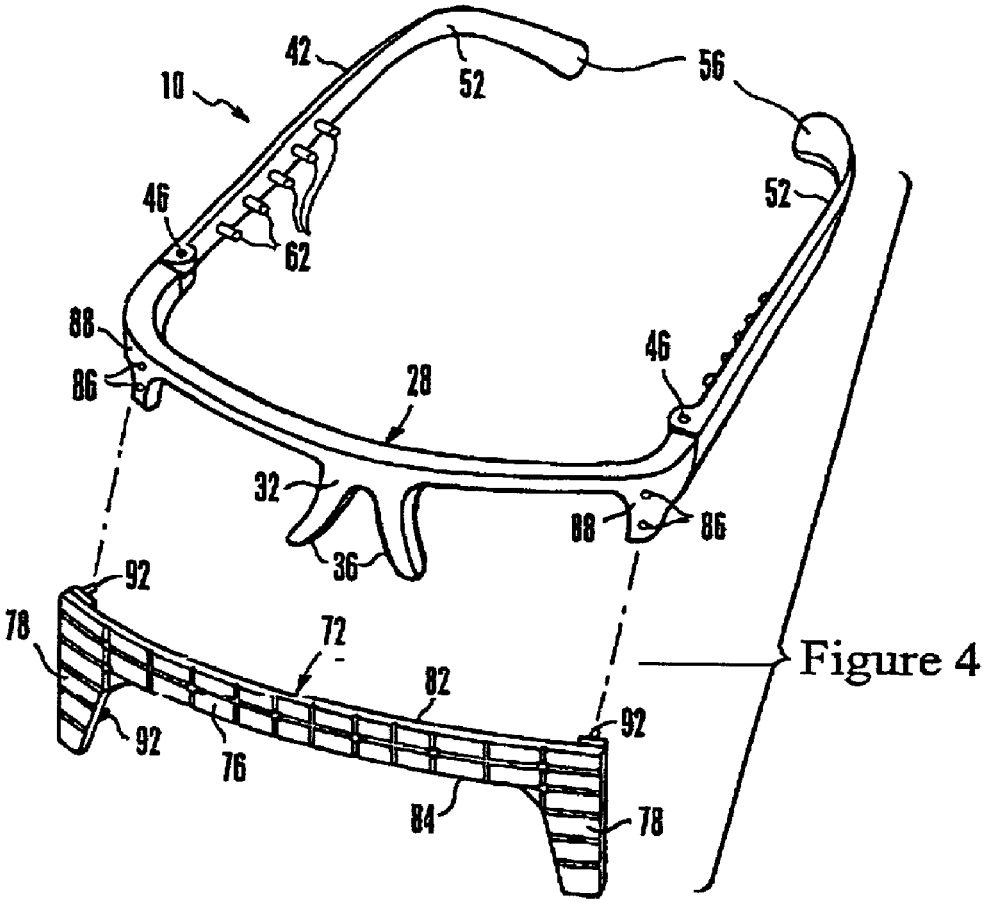
FIG. 4 is an exploded perspective view showing an alternative trim guide in accordance with the present invention.

The trim guide 10 may also be utilized in the cutting of hair located in other areas on the head, and an example of such an alternative preferred embodiment is shown in FIG. 4. A hair trim gauge 72 is positioned for attachment to the front face frame 28 of the trim guide 10. The hair trim gauge 72 includes a transverse extension 76 having a pair of lateral adjustment extensions 78, one formed at each end thereof. A first trimming surface 82 is formed along an upper edge of the transverse extension 76 and a second trimming surface 84 formed along a lower edge.

Attachment of the hair trim gauge 72 to the supporting structure of the trim gauge 10 preferably is accomplished by a similar structure as is utilized for attachment of the trim gauge 18 (not shown in FIG. 4). A pair of attachment apertures 86 is formed in each shield 88 of the front face frame 28. A plurality of attachment pegs 92 are formed in a linear arrangement along a back surface of each of the lateral adjustment extensions 78. The attachment pegs 92 are spaced apart a similar distance as the pair of attachment apertures, permitting their cooperative engagement with and receipt therein.

Figure 5:
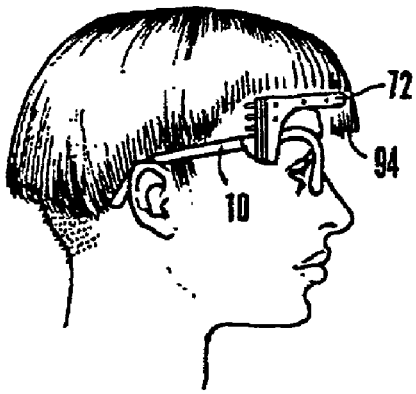
FIG. 5 is a partial perspective view of a side of the head of a person showing an alternative trim guide positioned thereon in accordance with the present invention.

In FIG. 5 the hair trim gauge 72 is shown as received by the trim guide 10 in an elevated manner. As so positioned, trimming along the first trimming surface 82 results in the formation of bangs having a shorter length. A length of untrimmed bangs 94 is shown in FIG. 5 illustrating this result.

Figure 6:
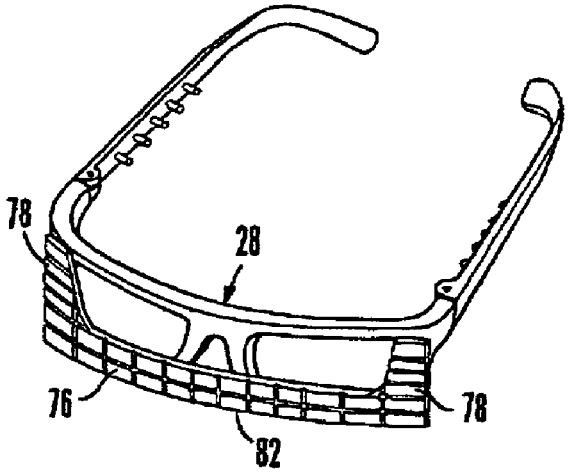
FIG. 6 is a perspective view showing an alternative trim guide attached to the supporting frame in an alternate manner in accordance with the present invention.

In addition to adjusting bang length by variance in the lateral position of the attachment pegs 92 selected to be received by the attachment apertures 86, it is also possible to invert the entire hair trim gauge 72. As is shown in FIG. 6, inversion of the hair trim gauge 72 does not alter the manner of its attachment to the front face frame 28. The linear arrangement of the attachment pegs 92 along the lateral adjustment extensions permits additional variance in the position of the first trimming surface 82 relative to a user"s hair (not shown in FIG. 6).

As with the trim gauge 18, the hair trim gauge 78 is preferably fabricated out of a plastic, such as Nylon of thickness 1⁄16". The hair trim gauge 72 extends 6 inches across, with the lateral adjustment extensions having an approximate length of 1½ inches. The attachment pegs are approximately ⅛ inches in diameter, and project approximately ¼ inches from their base of attachment on the lateral adjustment extensions 78. The attachment pegs 92 are spaced approximately ⅜ inches, center-to-center, as are the attachment apertures 86. By making use of all the vertical adjustment features, including inversion of the hair trim gauge 72, the first trimming surface 82 can be positioned from 1½ inches above the upper surface of the front face frame 28 to 1½ inches below.

My invention has been disclosed in terms of a preferred embodiment thereof, which provides an improved body hair trim guide that is of great novelty and utility. Various changes, modifications, and alterations in the teachings of the present invention may be contemplated by those skilled in the art without departing from the intended spirit and scope thereof. It is intended that the present invention encompass such changes and modifications.

The invention claimed is:

1. A hair trim guide comprising:

an eyeglass frame having a front face frame and a pair of temple pieces attached to and extending rearwardly from said front face frame, each of the pair of temple pieces biased inwardly and having a portion thereof resting upon an ear of a user when said eyeglass frame is positioned for use by said user;

a trim guide selectively pegged to said eyeglass frame; and a plurality of pegs attached to and projecting from said trim guide, said plurality of pegs configured in a pair of vertical arrays, wherein said trim guide comprises a pair of lateral adjustment extensions attached to and separated by a transverse extension, said transverse extension having a trimming surface formed thereon.

2. A hair trim guide according to claim 1, wherein one of said pair of vertical arrays of pegs is attached to each of said pair of lateral adjustment extensions.

3. A hair trim guide according to claim 2, wherein said pair of apertures are formed at opposite ends of a front face frame of said eyeglass frame.

4. A hair trim guide according to claim 3, wherein said front face frame has a pair of apertures formed at each of said opposite ends thereof.

* * * * *